US010800167B2

(12) United States Patent
Anderson et al.

(10) Patent No.: US 10,800,167 B2
(45) Date of Patent: Oct. 13, 2020

(54) LOW VOLTAGE BIAS OF NOZZLE SENSORS

(71) Applicant: HEWLETT-PACKARD DEVELOPMENT COMPANY, L.P., Fort Collins, CO (US)

(72) Inventors: Daryl E Anderson, Corvallis, OR (US); Eric Martin, Corvallis, OR (US); James Michael Gardner, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/317,883

(22) PCT Filed: Oct. 24, 2016

(86) PCT No.: PCT/US2016/058431

§ 371 (c)(1),
(2) Date: Jan. 15, 2019

(87) PCT Pub. No.: WO2018/080423

PCT Pub. Date: May 3, 2018

(65) Prior Publication Data

US 2019/0255837 A1 Aug. 22, 2019

(51) Int. Cl.

| | |
|---|---|
| ***B41J 2/045*** | (2006.01) |
| ***B41J 2/14*** | (2006.01) |
| ***B41J 2/125*** | (2006.01) |

(52) U.S. Cl.

CPC ..... *B41J 2/0452* (2013.01); *B41J 2/0458* (2013.01); *B41J 2/125* (2013.01); *B41J 2/14153* (2013.01);

(Continued)

(58) Field of Classification Search

CPC ..... B41J 2/0452; B41J 2/0458; B41J 2/125; B41J 2/14153; B41J 2/14201; B41J 2002/14354

See application file for complete search history.

(56) References Cited

U.S. PATENT DOCUMENTS 6,350,017 B1 2/2002 Kamada
8,070,267 B2 * 12/2011 Takeuchi ..... B41J 2/14129 347/22

(Continued)

FOREIGN PATENT DOCUMENTS

CN 101020387 8/2007
CN 103895350 7/2014

(Continued)

OTHER PUBLICATIONS

Handling Guide for Thermal Print Head, Feb. 12, 2008, < http://www.hokuto.co.jp/eng/products/thermal/pdf/precaution_e.pdf >.

*Primary Examiner* — Thinh H Nguyen
(74) *Attorney, Agent, or Firm* — Brooks, Cameron & Huebsch, PLLC

(57) ABSTRACT

Example implementations relate to low voltage bias of nozzle sensors. For example, a fluid ejection die according to the present disclosure may include a plurality of nozzles, and each nozzle may include a nozzle sensor and a fluid ejector, among other components. The fluid ejection die may also include a voltage reduction device to maintain a low voltage bias on the plurality of nozzle sensors during an operation of the plurality of nozzles. A plurality of sense circuits may be electrically coupled to a respective nozzle sensor among the plurality of nozzle sensors, and each sense circuit may evaluate a status of the respective nozzle after the operation.

15 Claims, 5 Drawing Sheets

(52) U.S. Cl.
CPC .. *B41J 2/14201* (2013.01); *B41J 2002/14354* (2013.01)

(56) References Cited

U.S. PATENT DOCUMENTS

| | | | |
|---|---|---|---|
| 9,044,936 | B2 | 1/2015 | Van Brocklin et al. |
| 9,283,750 | B2 | 3/2016 | Liao et al. |
| 2012/0056954 | A1 | 3/2012 | Asauchi et al. |
| 2014/0184702 | A1 | 7/2014 | Ishida et al. |

FOREIGN PATENT DOCUMENTS

| | | | |
|---|---|---|---|
| CN | 104339868 | | 2/2015 |
| JP | 2009072952 | A | 4/2009 |
| WO | WO-2005105455 | A1 | 11/2005 |

* cited by examiner

LOW VOLTAGE BIAS OF NOZZLE SENSORS

BACKGROUND

Fluid ejection systems may operate by ejecting a fluid from nozzles to form images on media and/or forming three dimensional objects, for example. In some fluid ejection systems, fluid droplets may be released from an array of nozzles in a fluid ejection die. The fluid may bond to a surface of a medium and forms graphics, text, images, and/or objects. Fluid ejection dies may include a number of fluid chambers, also known as firing chambers.

DETAILED DESCRIPTION

Figure 1A:
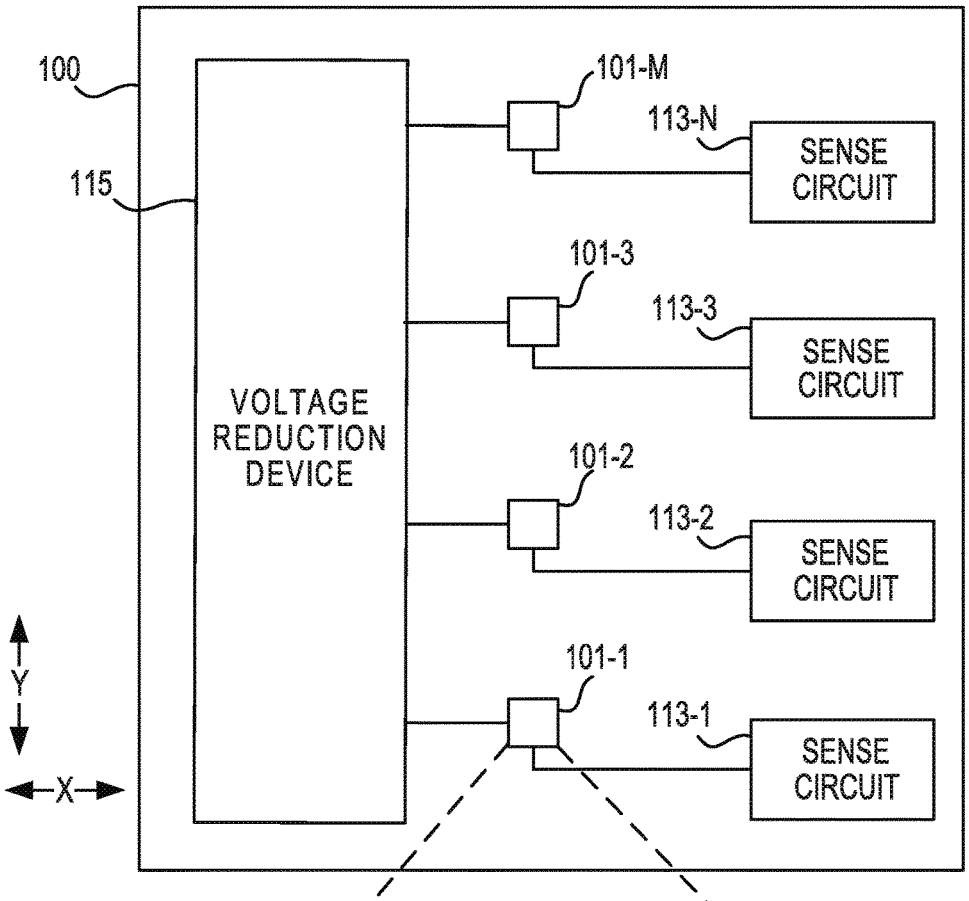
FIG. 1A illustrates a diagram of an example fluid ejection die, according to the present disclosure.

Each fluid chamber in a fluid ejection die may be in fluid communication with a nozzle in an array of nozzles, and may provide fluid to be deposited by that respective nozzle. Prior to a droplet release, the fluid in the fluid chamber may be restrained from exiting the nozzle due to capillary forces and/or back-pressure acting on the fluid within the nozzle passage. The meniscus, which is a surface of the fluid that separates the fluid in the chamber from the atmosphere located below the nozzle, may be held in place due to a balance of the internal pressure of the chamber, gravity, and the capillary force.

During a droplet release, fluid within the fluid chamber may be forced out of the nozzle by actively increasing the pressure within the chamber. Some fluid ejection dies may use a resistive heater positioned within the chamber to evaporate a small amount of at least one component of the fluid. The evaporated fluid component or components may expand to form a gaseous drive bubble within the fluid chamber. This expansion may exceed the restraining force enough to expel a droplet out of the nozzle. After the release of a droplet, the pressure in the fluid chamber may drop below the strength of the restraining force and the remainder of the fluid may be retained within the chamber. Meanwhile, the drive bubble may collapse and fluid from a reservoir may flow into the fluid chamber replenishing the lost fluid volume from the droplet release. This process may be repeated each time the fluid ejection die is instructed to fire.

As used herein, a drive bubble refers to a bubble formed from within a fluid chamber to dispense a droplet of fluid as part of a fluid ejection process or a servicing event. The drive bubble may be made of a vaporized fluid separated from liquid fluid by a bubble wall. The timing of the drive bubble formation may be dependent on the image and/or object to be formed.

Low voltage bias of nozzle sensors, according to the present disclosure, may prevent overvoltage damage and possible reverse bias induced latch-up to voltage sensitive circuits from coupled high voltage nozzle firing signals. As described herein, each nozzle on a fluid ejection die may include a sensor and a fluid ejector. A voltage reduction device may reduce a voltage on the nozzle sensors during operation of the nozzles.

As described herein, a fluid ejection system may include a plurality of nozzles, where each nozzle includes a nozzle sensor and a fluid ejector. The nozzle sensor may be disposed in proximity to the fluid ejector such that a change in voltage of the firing chamber may result in a change in voltage of the nozzle sensor. For instance, the nozzle sensor may be disposed above the firing resistor with a thin dielectric layer in between. This may form a capacitor. When a fire pulse hits the firing chamber, a voltage delta of over 30 volts may be coupled onto the nozzle sensor. The nozzle sensor may be electrically connected to devices that may not tolerate voltages in excess of about 6 or 7 volts. That is, when the firing pulse arrives at a respective nozzle, the high voltage rise and fall waveform of the nozzle may be capacitively coupled from the firing chamber of the nozzle to the sensor of the nozzle. A high voltage rise and fall of a nozzle sensor may damage and/or destroy sense circuitry electrically coupled to the nozzle sensor, and damage and/or destroy the fluid ejection die itself.

Figure 1B:
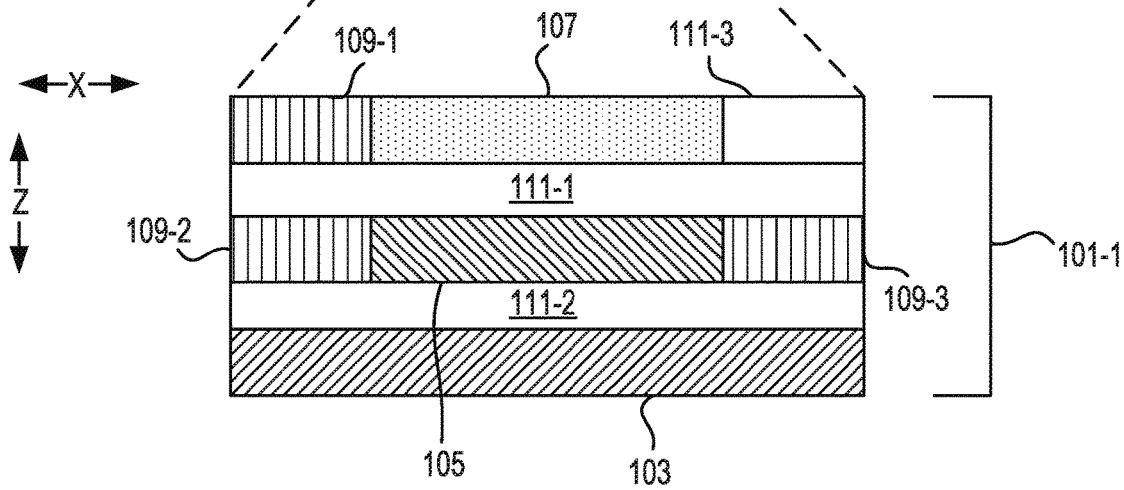
FIG. 1B illustrates a diagram of an example cross section of a nozzle, according to the present disclosure.

FIG. 1A illustrates a diagram of an example fluid ejection die 100, according to the present disclosure. As illustrated in FIG. 1A, fluid ejection die 100 may include a plurality of nozzles 101-1, 101-2, 101-3 . . . 101-M (referred to collectively as nozzles 101). Each nozzle among the plurality of nozzles 101 may include a nozzle sensor and a fluid ejector. As used herein, a nozzle sensor may refer to a device and/or component that may detect the formation of a bubble in the respective nozzle. Examples of nozzle sensors may include a cavitation plate and/or a sense plate among others. The nozzle sensor may be comprised of tantalum, tantalum-aluminum, gold and/or other materials. As used herein, a fluid ejector refers to a device and/or component that may cause ejection of a fluid responsive to application of a firing pulse. Examples of a fluid ejector may include a resistor, piezoelectric membrane, and/or other such components. For instance, FIG. 1B illustrates a cross section of a nozzle 101-1. Referring to FIG. 1B, a top view of the fluid ejection die 100 is illustrated in the X and Y axes, while a cross section of nozzle 101-1 is illustrated in the X and Z axes. While a cross section is illustrated for nozzle 101-1, it is to be understood that the same cross section may be illustrated for nozzles 101-2, 101-3 and 101-M. Nozzle 101-1 may include a substrate layer 103, a fluid ejector 105, and a nozzle sensor 107, among other components. As described herein, the nozzle sensor may be comprised of tantalum among other components. The fluid ejector 105 may be comprised of tantalum aluminum and/or tungsten-silicon-nitride, among other examples. Examples are not so limited, however, and the fluid ejector 105 may be comprised of any resistive material that concentrates power dissipation. The nozzle sensor 107 may be separated from the fluid ejector 105 by dielectric 111-1. Similarly, the fluid ejector 105 may be separated from the substrate 103 by dielectric 111-2.

Nozzle 101-1 may include additional components, such as metal 109-1, 109-2, and 109-3. Metal 109-2 and 109-3 may be disposed on opposite sides of fluid ejector 105. Moreover, metal 109-2 and metal 109-3 may be disposed on an opposite side of dielectric 111-2, relative to substrate 103. Similarly, metal 109-1 may be disposed on an opposite side of dielectric 111-1, relative to metal 109-2 and on an opposite side of nozzle sensor 107 relative to dielectric

111-3. Although not illustrated in FIG. 1B, each nozzle may include a fluid chamber. For instance, nozzle 101-1 may include a fluid chamber disposed on a surface of the nozzle 101-1, opposite dielectric 111-1.

Fluid ejection die 100 may include a voltage reduction device 115 to maintain a low voltage bias on the plurality of nozzle sensors during an operation of the plurality of nozzles 101. As used herein, a voltage reduction device refers to a device, a plurality of devices, and/or circuitry that is electrically coupled to the nozzles 101. For instance, the voltage reduction device 115 may be electrically coupled to the nozzle sensor 107 of nozzle 101-1, as well as the nozzle sensors for each of the nozzles 101. As such, voltage reduction device 105 may be electrically coupled to a respective nozzle sensor for each of nozzles 101-1, 101-2, 101-3, and 101-M.

Although FIG. 1A illustrates voltage reduction device 115 as a single component, examples are not so limited and voltage reduction device 105 may include a plurality of components. For instance, as described in relation to FIGS. 2 and 3, the voltage reduction device 115 may include a control line, where each nozzle sensor among the plurality of nozzle sensors is electrically coupled to the control line by a respective switch among a plurality of switches. That is, the nozzle sensor of nozzle 101-1 may be associated with a first switch coupling the nozzle sensor to the voltage reduction device, the nozzle sensor of nozzle 101-2 may be associated with a second switch coupling the nozzle sensor to the voltage reduction device 115, and so forth. For example, the voltage reduction device 115 may include a control line, and each nozzle sensor among the plurality of nozzle sensors may be electrically coupled to the control line by a gate of a respective N-type switch among a plurality of N-type switches. As used herein, an N-type switch refers to a device capable of amplifying and/or switching electronic signals using an N-type semiconductor. Examples of an N-type switch may include an N-type field-effect transistor (FET) and/or an N-type metal-oxide-semiconductor field-effect transistor (MOSFET). Examples are not so limited, however, and the plurality of nozzle sensors may be coupled to the control line in other ways. For instance, the voltage reduction device 115 may include a control line, and each nozzle sensor among the plurality of nozzle sensors may be electrically coupled to the control line by a gate of a respective P-type switch among a plurality of P-type switches. As used herein, a P-type switch refers to a device capable of amplifying and/or switching electronic signals using a P-type semiconductor. Examples of a P-type switch may include a P-type FET and/or a P-type MOSFET. In yet further examples, the voltage reduction device 115 may include a diode electrically coupled to a biased voltage, as discussed further herein.

Additionally, the fluid ejection die 100 may include a plurality of sense circuits 113-1, 113-2, 113-3 . . . 113-N (referred to collectively as sense circuits 113). Each sense circuit among the plurality of sense circuits 113 may be electrically coupled to a respective nozzle sensor among the plurality of nozzle sensors. That is, sense circuit 113-1 may be electrically coupled to nozzle sensor 107 of nozzle 101-1. Sense circuit 113-1 may evaluate a status of nozzle 101-1 after operation of nozzle 101-1. As used herein, to evaluate a status of the nozzle refers to determining a voltage of the nozzle sensor and/or determining the presence of ink in the nozzle, among other determinations. That is, each sense circuit among the plurality of sense circuits 113 may evaluate a status of the respective nozzle after operation of the respective nozzle.

To maintain a low voltage bias on the nozzle sensors on nozzles 101, the voltage reduction device 115 may be activated. As used herein, to activate the voltage reduction device 115 refers to application of an electrical signal to activate devices to conduct excessive electrical charge that may exist on a nozzle sensor to another supply voltage. That is, during a firing pulse of the plurality of nozzles 101, the voltage reduction device 115 may be active, and thereby connected to a low supply voltage. The low supply voltage may be a ground, 1V, or 2V, among other examples. Application of a low supply voltage to the nozzle sensors of the plurality of nozzles 101 may prevent high voltages to build up on the nozzle sensors due to capacitive coupling of the fire pulse onto the nozzle sensor, and may therefore prevent damage to the sense circuits 113.

In another example, as discussed further herein, the voltage reduction device 115 may include a plurality of diodes which may turn on when a respective nozzle sensor reaches a threshold voltage, thereby preventing high voltages to build up on the nozzle sensor due to capacitive coupling of the fire pulse onto the nozzle sensor.

Figure 2:
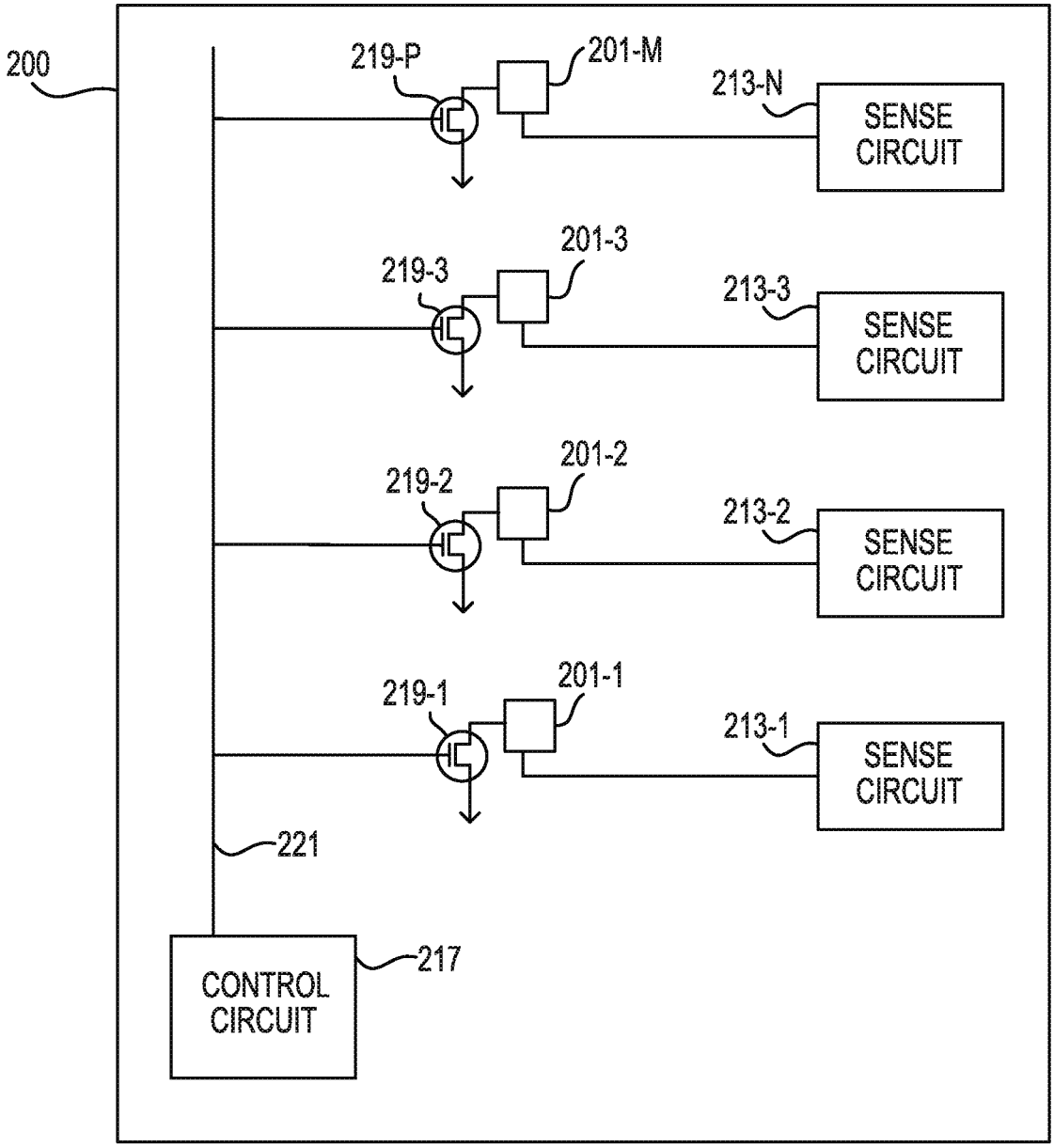
FIG. 2 further illustrates a diagram of an example fluid ejection die, according to the present disclosure.

FIG. 2 further illustrates a diagram of an example fluid ejection die 200, according to the present disclosure. The fluid ejection die 200 may be analogous to fluid ejection die 100 illustrated in FIG. 1A. As described in relation to FIG. 1B, the fluid ejection die 200 may include a plurality of nozzles 201, and each nozzle among the plurality of nozzles may include a nozzle sensor and a fluid ejector. As illustrated in FIG. 2, the voltage reduction device 115 of FIG. 1A may include a plurality of components. For instance, the voltage reduction device may include a control line 221 electrically coupled to a control circuit 217 and the plurality of nozzles 201.

As discussed with regard to FIG. 1A, and illustrated in FIG. 2, the nozzle sensor of each of the plurality of nozzles 201 may be coupled to a respective switch, 219-1, 219-2, 219-3 . . . 219-P (referred to collectively herein as switches 219). Although FIG. 2 illustrates switches 219 as N-type MOSFETs, examples are not so limited, and switches 219 may be other types of switches. Sometime before a firing pulse or firing pulse train is applied to the fluid ejector, a signal may be transmitted from control circuit 217 to each of the switches 219, via control line 221, thereby activating each of the plurality of switches 219 and generating a biased voltage on the nozzle sensors of the nozzles 201. That is, each of the N-type FETs (e.g., 219) illustrated in FIG. 2 may be turned on, and a low voltage supply may be applied to the nozzle sensors on each of nozzles 201. The switches 219 may be held in this state by the control circuit 217 until the firing pulse of the fluid ejector has ended. Once the firing pulse has ended, the control circuit 217 may turn off the switches 219, disconnecting the nozzle sensors from the low voltage supply, allowing the nozzle sensors to respond electrically to the sense circuits 213 with a status update, such as with a voltage of the nozzle sensor.

Put another way, the control line 221 may be electrically coupled to the plurality of nozzle sensors by a plurality of FETs 219-1, 219-2, 219-3, 219-P. The control line 221 may maintain a low voltage bias on the plurality of nozzle sensors during an operation of the plurality of nozzles 201. That is, the control circuit 217, via the control line 221, may active the plurality of FETs 219 prior to application of a firing pulse to the plurality of fluid ejectors. Similarly, the control line 221 may deactivate the plurality of FETs 219 responsive to termination of the firing pulse applied to the plurality of fluid ejectors.

As illustrated in FIG. 2 and discussed with regard to FIG. 1, the fluid ejection die 200 may include a plurality of sense circuits 213. Each sense circuit among the plurality of sense circuits 213 may be electrically coupled to a respective nozzle sensor among the plurality of nozzle sensors. That is, sense circuit 213-2 may be electrically coupled to the nozzle sensor of nozzle 201-2, and sense circuit 213-3 may be electrically coupled to the nozzle sensor of nozzle 201-3, etc. The plurality of sense circuits 213 may determine a voltage of each of the plurality of nozzle sensors responsive to application of a firing pulse to the plurality of fluid ejectors. That is, responsive to deactivation of the plurality of FETs 219, each nozzle sensor among the plurality of nozzle sensors may transmit a status response to the respective sense circuit including a voltage of the nozzle sensor. In such a manner, the sense circuits 213 may determine the voltage of the nozzle sensor of each of the nozzles 201 after firing.

Figure 3:
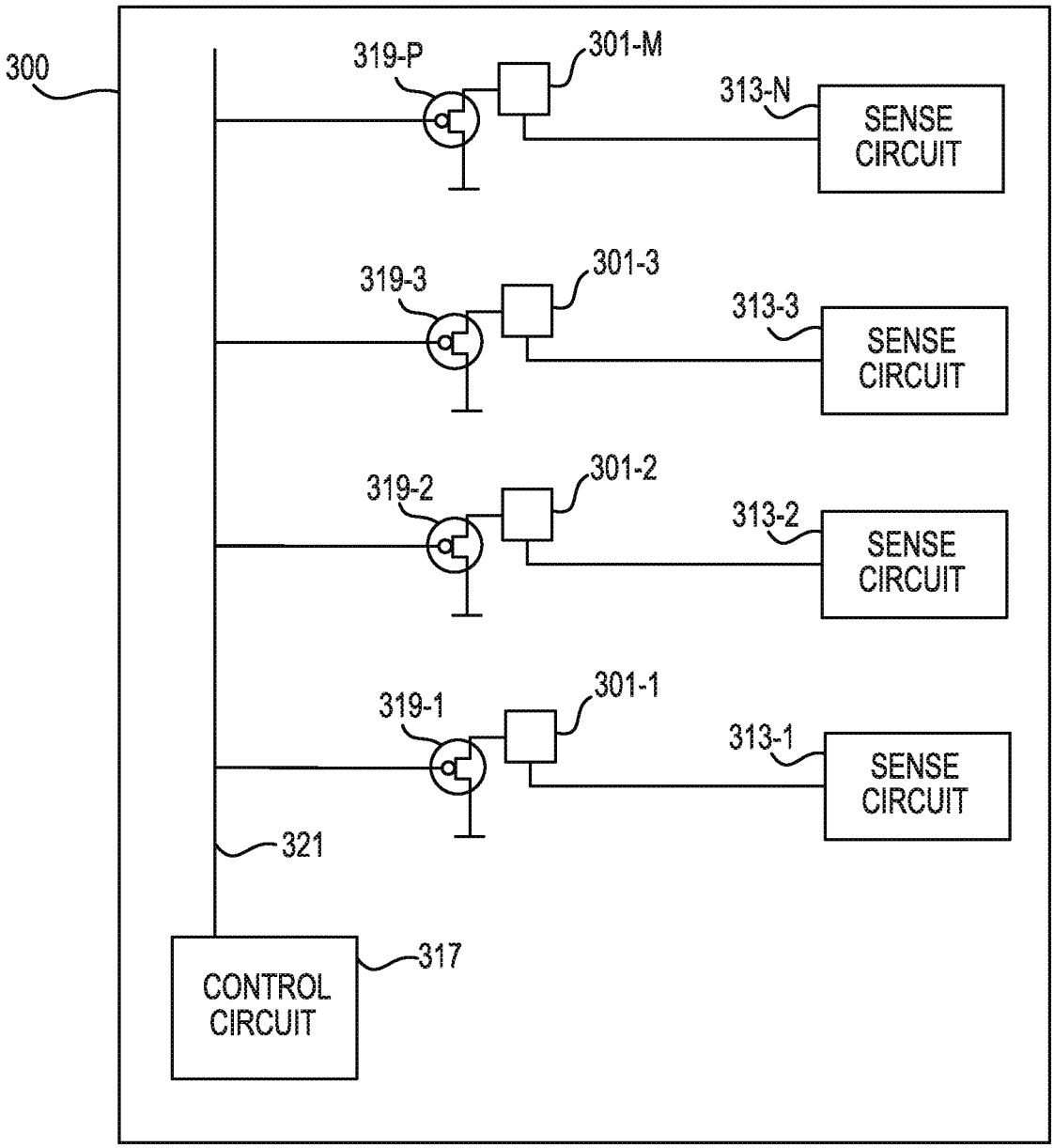
FIG. 3 further illustrates a diagram of an example fluid ejection die, according to the present disclosure.

FIG. 3 further illustrates a diagram of an example fluid ejection die 300, according to the present disclosure. The fluid ejection die 300 may be analogous to fluid ejection die 100 illustrated in FIG. 1A, and the fluid ejection die 200 illustrated in FIG. 2. As described in relation to FIGS. 1A and 2, the fluid ejection die 300 may include a plurality of nozzles 301, and each nozzle among the plurality of nozzles may include a nozzle sensor and a fluid ejector. As illustrated in FIG. 3, the voltage reduction device 115 of FIG. 1A may include a plurality of components. For instance, the voltage reduction device may include a control line 321 electrically coupled to a control circuit 317 and the plurality of nozzles 301.

As discussed with regard to FIG. 1A, and illustrated in FIG. 3, the nozzle sensor of each of the plurality of nozzles 201 may be coupled to a respective switch, 319-1, 319-2, 319-3 . . . 319-P (referred to collectively herein as switches 319). Although FIG. 3 illustrates switches 319 as P-type MOSFETs, examples are not so limited, and switches 319 may be other types of switches. Also, as illustrated in FIGS. 2 and 3, the switches (e.g. 219 and 319) may be oriented such that a first side of the switch is electrically coupled to a nozzle sensor among the plurality of nozzle sensors, a second side of the switch is electrically coupled to a low supply voltage, and a gate of the switch electrically coupled to the control line. For instance, referring to FIG. 3, the switches 319 may be oriented such that a source of switch 319-3 is electrically coupled to nozzle sensor 301-3, a gate of switch 319-3 is electrically coupled to control line 321, and a drain of switch 319-3 is electrically coupled to a low supply voltage, such as ground, or a low voltage bias. That is, instead of FETs 319 connected to ground, as illustrated in FIG. 3, the FETs (e.g., switches) 319 may be connected from the nozzle sensor to another safe supply. As used herein, a safe supply refers to a power supply that can sink the coupled charge from the nozzle sensor, not allowing the voltage nozzle sensor to build above a threshold voltage. Similarly, although FIGS. 2 and 3 illustrate switches 319, examples are not so limited. That is, voltage reduction device 115 illustrated in FIG. 1A may include a plurality of diodes, where a different respective diode is electrically coupled to each respective nozzle sensor. That is, a first diode may be electrically coupled to the nozzle sensor of nozzle 301-M, a second diode may be electrically coupled to the nozzle sensor of nozzle 301-3, a third diode may be electrically coupled to the nozzle sensor of nozzle 301-2, and a fourth diode may be electrically coupled to the nozzle sensor of nozzle 301-1. In such an example, the diodes may activate or "turn on" at a diode voltage such as 0.7V above the supply it is connected to. That is, the diodes may turn on once the voltage of the associated nozzle sensor reaches a threshold voltage.

As described in relation to FIG. 2, before a firing pulse, or before firing a pulse train applied to the fluid ejector, a signal may be transmitted from control circuit 317 to each of the switches 319, via control line 321, thereby activating each of the plurality of switches 319 and generating a biased voltage on the nozzle sensors of the nozzles 301. That is, each of the P-type FETs (e.g., 319) illustrated in FIG. 3 may be turned on, and a low voltage supply may be applied to the nozzle sensors on each of nozzles 301. The switches 319 may be held in this state by the control circuit 317 until the firing pulse of the fluid ejector has ended. Once the firing pulse has ended, the control circuit 317 may turn off the switches 319, disconnecting the nozzle sensors from the low voltage supply, allowing the nozzle sensors to respond electrically to the sense circuits 313 with a status update.

Figure 4:
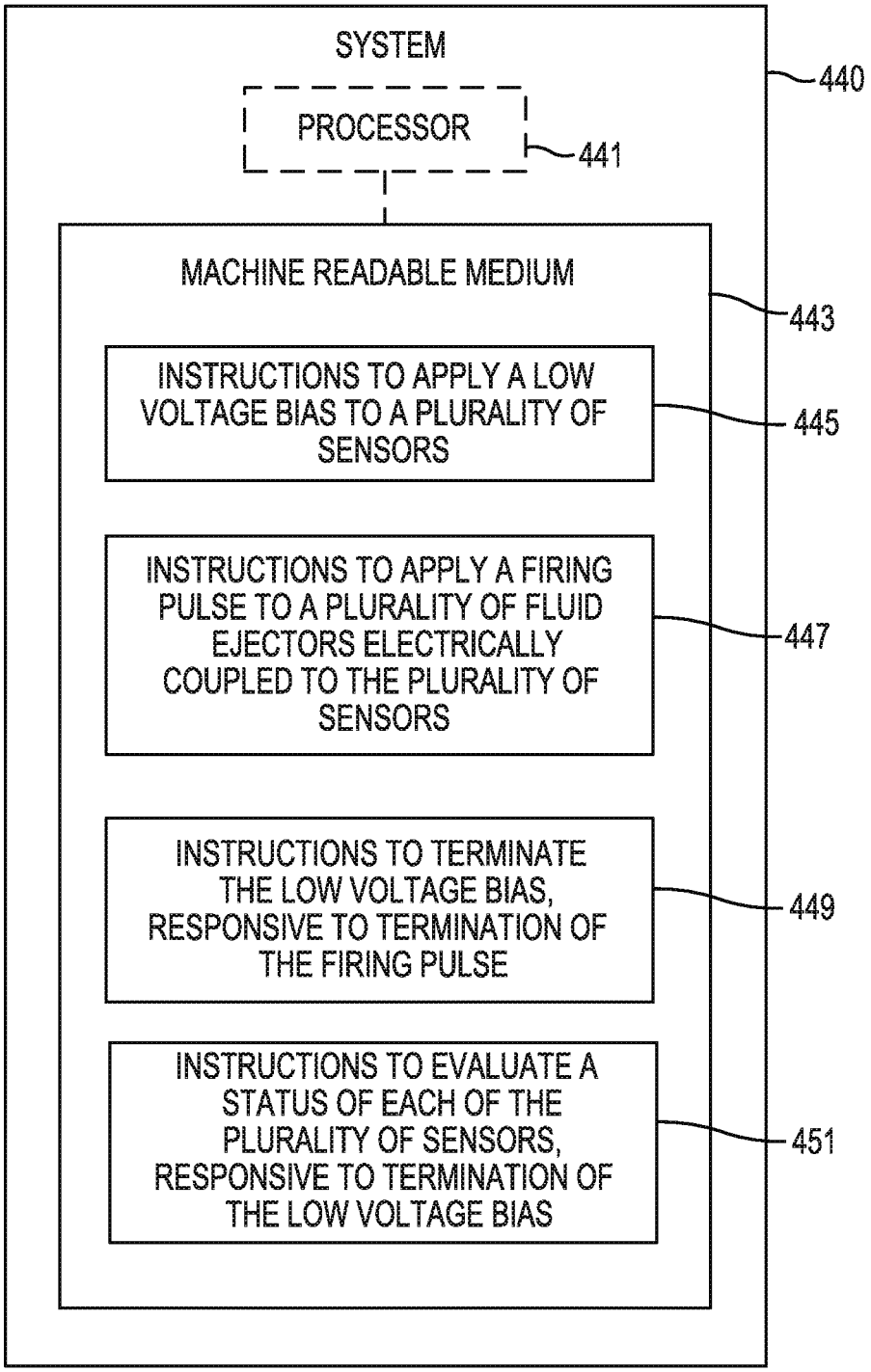
FIG. 4 is a block diagram of an example system for low voltage bias of nozzle sensors, according to the present disclosure.

FIG. 4 is a block diagram of an example system 440 for low voltage bias of nozzle sensors, according to the present disclosure. System 440 may include at least one computing device that is capable of communicating with at least one remote system. In the example of FIG. 4, system 440 includes a processor 441 and a machine readable medium 443. Although the following descriptions refer to a single processor and a single machine readable medium, the descriptions may also apply to a system with multiple processors and machine readable mediums. In such examples, the instructions may be distributed (e.g., stored) across multiple machine readable mediums and the instructions may be distributed (e.g., executed by) across multiple processors.

Processor 441 may be a central processing units (CPU), microprocessor, and/or other hardware device suitable for retrieval and execution of instructions stored in machine readable medium 443. In the particular example shown in FIG. 4, processor 441 may receive, determine, and send instructions 445, 447, 449, and 451 for low voltage bias of nozzle sensors. As an alternative or in addition to retrieving and executing instructions, processor 441 may include an electronic circuit comprising a number of electronic components for performing the functionality of the instructions in machine readable medium 443. With respect to the executable instruction representations (e.g., boxes) described and shown herein, it should be understood that part or all of the executable instructions and/or electronic circuits included within one box may, in alternate embodiments, be included in a different box shown in the figures or in a different box not shown.

Machine readable medium 443 may be any electronic, magnetic, optical, or other physical storage device that stores executable instructions. Thus, machine readable medium 443 may be, for example, Random Access Memory (RAM), an Electrically-Erasable Programmable Read-Only Memory (EEPROM), a storage drive, an optical disc, and the like. Machine readable medium 443 may be disposed within system 440, as shown in FIG. 4. In this situation, the executable instructions may be "installed" on the system 440. Additionally and/or alternatively, machine readable medium 443 may be a portable, external or remote storage medium, for example, that allows system 440 to download the instructions from the portable/external/remote storage medium. In this situation, the executable instructions may be part of an "installation package". As described herein, machine readable medium 443 may be encoded with executable instructions for low voltage bias of nozzle sensors.

Referring to FIG. 4, the instructions 445, when executed by a processor (e.g., 441), may cause system 440 to maintain a low voltage bias on a plurality of nozzle sensors, each of the plurality of nozzle sensors associated with a different respective nozzle among a plurality of nozzles. The instructions 445 to maintain the low voltage bias may include instructions to turn on a plurality of switches electrically coupling the plurality of nozzle sensors and a control line, as discussed in relation to FIGS. 2 and 3. Moreover, the instructions 445 to maintain the low voltage bias may include instructions to maintain the low voltage bias using a control line electrically coupled to the plurality of nozzle sensors.

The instructions 447, when executed by a processor (e.g., 441), may cause system 440 to apply a firing pulse to a plurality of fluid ejectors capacitatively coupled to the plurality of nozzle sensors, responsive to application of the low voltage bias. As used herein, to capacitatively couple components refers to the transfer of energy between the components by displacement of a current, rather than by a direct electrical connection. Sometime before a firing pulse or firing pulse train is applied to the fluid ejector, a signal may be transmitted from the control circuit to each of the switches, via a control line, thereby activating each of the plurality of switches and generating a biased voltage on the nozzle sensors of the nozzles. As used herein, a firing train refers to a series of firing signals consisting of a non-nucleating pulse, a dead time, and a main nucleating pulse.

The instructions 449, when executed by a processor (e.g., 441), may cause system 440 to terminate the low voltage bias, responsive to termination of the firing pulse. That is, the instructions 449 to terminate the low voltage bias may include instructions to turn off a plurality of switches electrically coupling the plurality of nozzle sensors and a control line, as discussed in relation to FIGS. 2 and 3.

The instructions 451, when executed by a processor (e.g., 441), may cause system 440 to evaluate a status of each of the plurality of nozzle sensors, responsive to termination of the low voltage bias.

Figure 5:
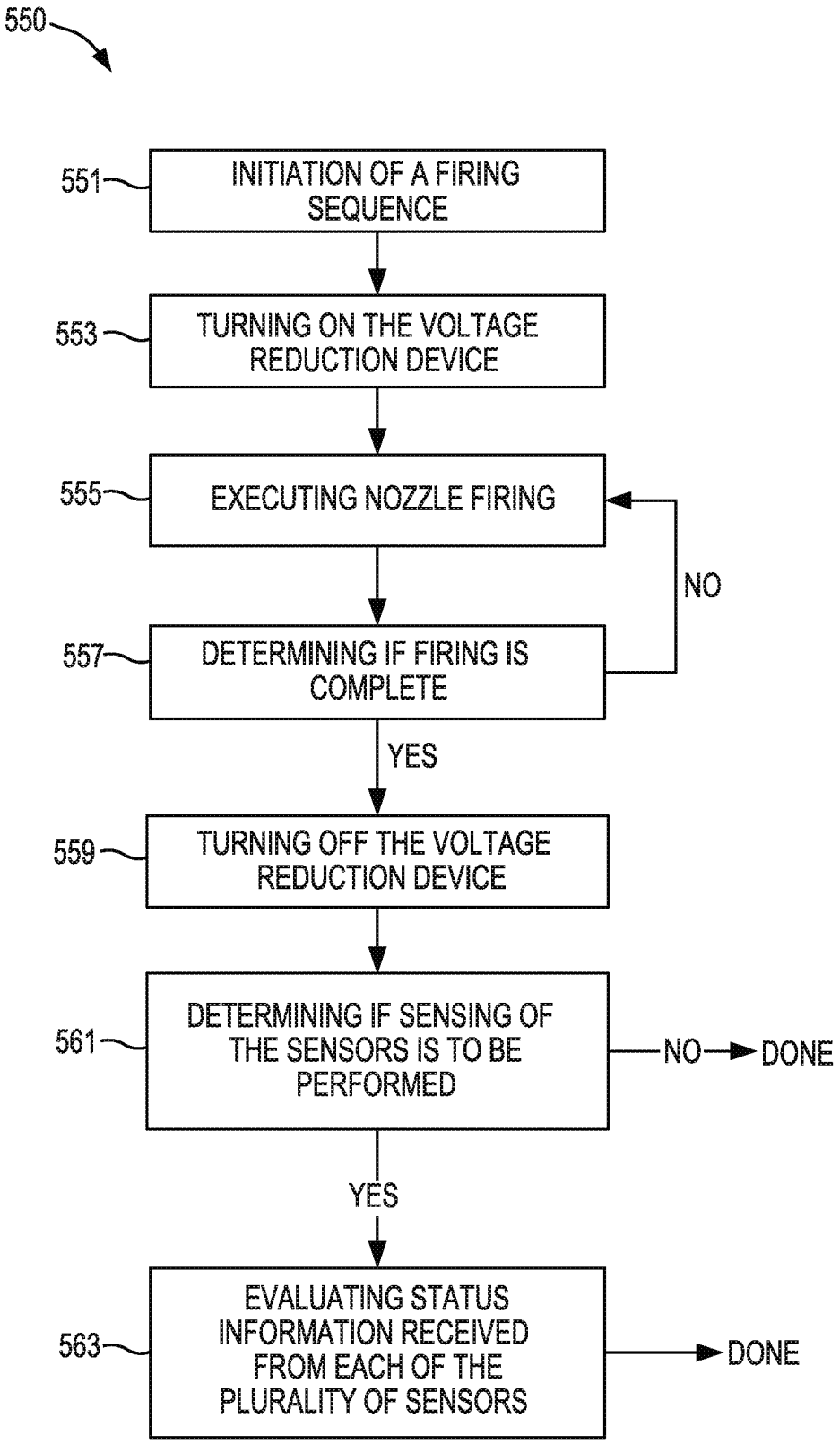
FIG. 5 illustrates an example method for low voltage bias of nozzle sensors, according to the present disclosure.

FIG. 5 illustrates an example method 550 for low voltage bias of nozzle sensors, according to the present disclosure. As illustrated in FIG. 5, the method 550 may begin with initiation of a firing sequence at 551. As used herein, a firing sequence refers to applying a voltage to a resistive element, such as fluid ejector 105 illustrated in FIG. 1B, to create a drive bubble in a fluid chamber. At 553, the method 550 may include turning on the voltage reduction device, thereby maintaining a low voltage bias on all nozzle sensors. As described herein, maintaining a low voltage bias on the nozzle sensors may be performed by turning on N-type FETs coupled to the nozzle sensors, and/or turning on P-type FETs coupled to the nozzle sensors, among other examples.

At 555, the method 550 may include executing the nozzle firing. That is, while a low voltage bias is applied to each of the nozzle sensors, the associated fluid ejector may fire. At 557, the method 550 may include determining if the firing is complete. The duration of a firing event may be known, and maintained in a register as a number of clock pulse durations. These clock pulse counters may determine when the firing pulse should be terminated, and when the next firing sequence should begin. If firing is not complete, the voltage reduction device may remain active, and the nozzles may fire again. Conversely, if it is determined that firing is complete, at 559 the method 550 may include turning off the voltage reduction device. That is, the method 550 may include turning off the FETs, as discussed in regard to FIGS. 2 and 3. At 561, the method 550 may include determining if sensing of the nozzle sensors is to be performed. To determine if sensing of the nozzle sensor is to be performed, a bit in a header of the firing sequence data may be set, indicating that sensing of the nozzle sensors is to be performed after the firing event. For example, if sensing is to be performed, the sense circuits (e.g., 213 illustrated in FIG. 2 and 313 illustrated in FIG. 3) may request status information from each of the plurality of nozzle sensors. Therefore, at 563, the method 550 may include evaluating the status information received from each of the plurality of nozzle sensors.

In the foregoing detailed description of the present disclosure, reference is made to the accompanying drawings that form a part hereof, and in which is shown by way of illustration how examples of the disclosure may be practiced. These examples are described in sufficient detail to enable those of ordinary skill in the art to practice the examples of this disclosure, and it is to be understood that other examples may be utilized and that process, electrical, and/or structural changes may be made without departing from the scope of the present disclosure.

The figures herein follow a numbering convention in which the first digit corresponds to the drawing figure number and the remaining digits identify an element or component in the drawing. Elements shown in the various figures herein can be added, exchanged, and/or eliminated so as to provide a number of additional examples of the present disclosure. In addition, the proportion and the relative scale of the elements provided in the figures are intended to illustrate the examples of the present disclosure, and should not be taken in a limiting sense. As used herein, the designator "M", "N", and "P", particularly with respect to reference numerals in the drawings, indicates that a number of the particular feature so designated can be included with examples of the present disclosure. The designators can represent the same or different numbers of the particular features.

What is claimed:

1. A fluid ejection die comprising:

a plurality of nozzles, each nozzle among the plurality of nozzles including:

a nozzle sensor that detects a formation of a drive bubble in a corresponding nozzle of the plurality of nozzles; and a fluid ejector;

a voltage reduction device to maintain a low voltage bias on the plurality of nozzle sensors during an operation of the plurality of nozzles; and a plurality of sense circuits, each sense circuit among the plurality of sense circuits electrically coupled to a respective nozzle sensor among the plurality of nozzle sensors, each sense circuit to evaluate a status of the respective nozzle sensor after the operation.

2. The fluid ejection die of claim 1, the voltage reduction device including a control line, each nozzle sensor among the plurality of nozzle sensors electrically coupled to the control line by a respective switch among a plurality of switches.

3. The fluid ejection die of claim 1, the voltage reduction device including a control line, a first side of a switch electrically coupled to a nozzle sensor among the plurality of nozzle sensors, a second side of the switch electrically coupled to a low supply voltage, and a gate of the switch electrically coupled to the control line.

4. The fluid ejection die of claim 1, the voltage reduction device including a control line, each nozzle sensor among the plurality of nozzle sensors electrically coupled to the control line by a gate of a respective N-type switch among a plurality of N-type switches.

5. The fluid ejection die of claim 1, the voltage reduction device including a control line, each nozzle sensor among the plurality of nozzle sensors electrically coupled to the control line by a gate of a respective P-type switch among a plurality of P-type switches.

6. The fluid ejection die of claim 1, the voltage reduction device including a diode electrically coupled to a low biased voltage.

7. A fluid ejection die comprising:

a plurality of nozzles, each nozzle among the plurality of nozzles including a nozzle sensor and a fluid ejector;

a control line to electrically couple to the plurality of nozzle sensors by a plurality of field effect transistors (FETs), the control line to maintain a low voltage bias on the plurality of nozzle sensors during an operation of the plurality of nozzles; and a plurality of sense circuits, each sense circuit among the plurality of sense circuits electrically coupled to a respective nozzle sensor among the plurality of nozzle sensors.

8. The fluid ejection die of claim 7, the control line to activate the plurality of FETs prior to application of a firing pulse to the plurality of fluid ejectors.

9. The fluid ejection die of claim 7, the control line to deactivate the plurality of FETs responsive to termination of a firing pulse applied to the plurality of fluid ejectors.

10. The fluid ejection die of claim 7, the plurality of sense circuits to determine a voltage of each of the plurality of nozzle sensors responsive to application of firing pulse to the plurality of fluid ejectors.

11. The fluid ejection die of claim 7, responsive to deactivation of the plurality of FETs, each nozzle sensor among the plurality of nozzle sensors to:

transmit a status response to the respective sense circuit including a voltage of the nozzle sensor.

12. A non-transitory machine readable medium storing instructions executable by a processor, causing the processor to:

maintain a low voltage bias on a plurality of nozzle sensors, each of the plurality of nozzle sensors associated with a different respective nozzle among a plurality of nozzles;

responsive to application of the low voltage bias, apply a firing pulse to a plurality of fluid ejectors capacitatively coupled to the plurality of nozzle sensors;

terminate the low voltage bias, responsive to termination of the firing pulse; and evaluate a status of each of the plurality of nozzle sensors, responsive to termination of the low voltage bias.

13. The non-transitory machine readable medium of claim 12, the instructions to maintain the low voltage bias including instructions to turn on a plurality of switches electrically coupling the plurality of nozzle sensors and a control line.

14. The non-transitory machine readable medium of claim 12, the instructions to terminate the low voltage bias including instructions to turn off a plurality of switches electrically coupling the plurality of nozzle sensors and a control line.

15. The non-transitory machine readable medium of claim 12, the instructions to maintain the low voltage bias including instructions to maintain the low voltage bias using a control line electrically coupled to the plurality of nozzle sensors.

* * * * *